US010570790B2

(12) United States Patent
Nakamura

(10) Patent No.: US 10,570,790 B2
(45) Date of Patent: Feb. 25, 2020

(54) BREATHER DEVICE OF INTERNAL COMBUSTION ENGINE

(71) Applicant: HONDA MOTOR CO., LTD., Minato-ku, Tokyo (JP)

(72) Inventor: Mayuka Nakamura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/035,937

(22) Filed: Jul. 16, 2018

(65) Prior Publication Data

US 2019/0055865 A1 Feb. 21, 2019

(30) Foreign Application Priority Data

Aug. 21, 2017 (JP) ..... 2017-158859

(51) Int. Cl.
*F02B 75/20* (2006.01)
*F01M 13/00* (2006.01)
(Continued)

(52) U.S. Cl.
CPC ..... *F01M 13/0011* (2013.01); *F01M 11/0004* (2013.01); *F01M 13/04* (2013.01);
(Continued)

(58) Field of Classification Search
CPC ..... F01M 13/0416; F01M 2013/0461; F01M 35/10078
(Continued)

(56) References Cited

U.S. PATENT DOCUMENTS 7,942,122 B2 * 5/2011 Shieh ..... F01M 13/0416 123/572
8,065,993 B2 * 11/2011 Festag ..... F01M 13/0416 123/572
(Continued)

FOREIGN PATENT DOCUMENTS

JP S6069309 U 5/1985
JP 2003293725 A 10/2003
JP 2015-094239 A 5/2015

OTHER PUBLICATIONS

Notification of Reasons for Refusal for Japanese Patent Application No. 2017-158859, dated Jan. 8, 2019 , 3 pages.

*Primary Examiner* — Long T Tran
*Assistant Examiner* — James J Kim
(74) *Attorney, Agent, or Firm* — Armstrong Teasdale LLP

(57) ABSTRACT

In a breather device of an internal combustion engine, a breather chamber is defined by a head cover main body and a chamber forming member. The breather device includes an upstream breather passage communicating a first end of the breather chamber with a crank chamber, a downstream breather passage communicating a second end of the breather chamber with an intake passage, an oil return passage formed in a cylinder head to communicate a valve actuation chamber with the crank chamber, a first communication hole formed in a lower part of a recessed part of the breather chamber adjoining the first end of the breather chamber to communicate the breather chamber with the valve actuation chamber, and a second communication hole formed in a part of the breather chamber downstream of the first communication hole to communicate the breather chamber with the valve actuation chamber.

10 Claims, 11 Drawing Sheets

(51) Int. Cl.
*F01M 11/00* (2006.01)
*F01M 13/04* (2006.01)

(52) U.S. Cl.
CPC ..... *F01M 2011/0033* (2013.01); *F01M 2013/0044* (2013.01); *F01M 2013/0066* (2013.01); *F01M 2013/0461* (2013.01); *F02B 75/20* (2013.01)

(58) Field of Classification Search
USPC ..... 123/58.1, 572–574
See application file for complete search history.

(56) References Cited

U.S. PATENT DOCUMENTS

| | | | | |
|---|---|---|---|---|
| 8,887,705 | B2 * | 11/2014 | Aquino | F02M 25/06 123/572 |
| 9,133,742 | B2 * | 9/2015 | Hwang | F01M 13/04 |
| 2004/0159313 | A1 * | 8/2004 | Obayashi | F01M 13/04 123/572 |
| 2005/0092267 | A1 * | 5/2005 | Nonaka | F01M 13/0416 123/41.86 |
| 2008/0047519 | A1 * | 2/2008 | Naito | F01M 13/0416 123/193.5 |
| 2013/0074815 | A1 * | 3/2013 | Yuge | F01M 13/023 123/574 |
| 2013/0276767 | A1 * | 10/2013 | Polichetti | F01M 13/04 123/573 |
| 2015/0167515 | A1 * | 6/2015 | Nomura | F01M 13/04 123/573 |
| 2016/0265404 | A1 * | 9/2016 | Fujii | F01M 13/0416 |
| 2019/0055865 | A1 * | 2/2019 | Nakamura | F01M 13/0011 |

* cited by examiner

BREATHER DEVICE OF INTERNAL COMBUSTION ENGINE

TECHNICAL FIELD

The present invention relates to a breather device of an internal combustion engine for recirculating the blow-by gas produced in a crank chamber to an intake passage by intake negative pressure.

BACKGROUND ART

In an internal combustion engine, the combustion gas produced in the combustion chamber inevitably leaks to the crank chamber owing to the combustion pressure produced in the combustion chamber. The combustion gas that has leaked to the crank chamber is known as blow-by gas, and is typically recirculated to an intake passage via a breather device by using the negative pressure in the intake passage. The breather device is provided with a breather chamber for removing oil mist from the blow-by gas drawn from the crank chamber via a breather passage. Also, for the purpose of positively displacing the blow-by gas from the crank chamber, fresh air may be introduced into the crank chamber via a fresh air introduction passage. Since the blow-by gas may flow out of the crank chamber via the fresh air introduction passage in the opposite direction to that of the fresh air, the fresh air introduction passage may be provided with a fresh air chamber for separating oil therefrom. See JP2015-094239A, for instance.

FIG. 11 of JP2015-094239A illustrates a breather device provided with a breather chamber separated into a first gas liquid separation chamber located on the upstream side and communicating with the crank chamber, and a second gas liquid separation chamber located on the downstream side and communicating with the intake manifold. A part of the bottom wall of the first gas liquid separation chamber is provided with an oil return hole for returning the separated oil back to the oil reservoir (oil pan) of the engine, and an auxiliary opening is provided adjacent to the oil return hole for communicating the first gas liquid separation chamber with the valve actuation chamber. The oil return hole also serves as a breather passage for communicating the crank chamber with the first gas liquid separation chamber. Thereby, even when the blow-by gas is voluminous, and a relatively large amount of oil is separated in the first gas liquid separation chamber, the breather passage is prevented from being clogged by the separated oil so that the blow-by gas is allowed to be introduced into the breather chamber in a favorable manner without fail.

When a vehicle corners or accelerates/decelerates, the oil contained in the oil reservoir is subjected to an acceleration so that the oil level in the oil reservoir tilts with respect to the engine. As a result, the upstream end (lower end) of the breather passage may be submerged in the oil. In such a case, the oil of the oil reservoir may be drawn upward in the breather passage, and may even reach the breather chamber. If an auxiliary opening is formed in a bottom part of the breather chamber as disclosed in JP2015-094239A, the negative pressure in the breather chamber is weakened by the air drawn from the valve actuation chamber into the breather chamber via the auxiliary opening so that the rise of the oil into the breather chamber can be avoided.

However, since the auxiliary opening is provided in a part of the bottom wall of the breather chamber adjacent to an upstream end part of the breather chamber, the auxiliary opening may be flooded by the oil when a large amount of oil is present in the first oil separation chamber so that the negative pressure may not be weakened so much as desired. This may be avoided by increasing the size of the auxiliary opening, but the oil splashed in the valve actuation chamber may be drawn into the breather chamber along with gas due to the large opening area of the auxiliary opening.

SUMMARY OF THE INVENTION

In view of such a problem of the prior art, a primary object of the present invention is to provide a breather device of an internal combustion engine that can prevent the oil in the oil reservoir from rising upward in the breather passage, and prevent the oil splash in the valve actuation chamber from entering the breather chamber along with gas, at the same time.

To achieve such objects, one aspect of the present invention provides a breather device (35) of an internal combustion engine having a plurality of cylinders arranged in a row, comprising; a head cover main body (41) having an upper wall (41A) extending over at least a large part of a cylinder head (3) of the engine and including a downwardly recessed part,(41D), and a peripheral wall (41B) depending from a peripheral part (41E)of the upper wall, a lower end of the peripheral wall abutting the cylinder head to define a valve actuation chamber jointly with the cylinder head; a chamber forming member (42) attached to the upper wall of the head cover main body so as to define a breather chamber (54, 55) extending in a cylinder row direction in cooperation with the upper wall of the head cover main body; an upstream breather passage (36A) communicating a first end of the breather chamber with a crank chamber; a downstream breather passage (36B) communicating a second end of the breather chamber with an intake passage (20); an oil return passage (38) formed in the cylinder head to communicate the valve actuation chamber with the crank chamber; a first communication hole (65) formed in a lower part of the downwardly recessed part adjoining the first end of the breather chamber to communicate the breather chamber with the valve actuation chamber; and a second communication hole formed in a part of the breather chamber downstream of the first communication hole to communicate the breather chamber with the valve actuation chamber.

Because the second communication hole is provided in the part of the breather chamber downstream of the first communication hole, the second communication hole can continue to communicate the breather chamber with the valve actuation chamber even when the first communication hole is submerged in oil or is otherwise clogged by oil so that the negative pressure in the breather chamber can be weakened, and the rise of oil in the upstream breather passage can be suppressed. Also, the cross sectional area of the first communication hole can be reduced owing to the provision of the second communication hole so that the intrusion of oil from the valve actuation chamber into the breather chamber can be minimized.

Preferably, the second communication hole has a smaller cross sectional area than the first communication hole.

Thereby, the intrusion of oil from the valve actuation chamber into the breather chamber can be particularly minimized.

In a preferred embodiment of the present invention, the second communication hole is formed in a lower part of a side wall (54D) defining the downwardly recessed part (41D), a gap (G) facing the valve actuation chamber being defined between the peripheral wall (41B) and the side wall.

Since the gap is relatively inaccessible for the oil splashed in the valve actuation chamber, the oil in the valve actuation chamber can be effectively prevented from entering the breather chamber. Also, the second communication hole is formed in the lower part of the side wall, and is therefore directed sideways. This also contributes to the prevention of intrusion oil into the breather chamber.

Preferably, a part of the peripheral wall opposing the gap includes a bulging part (67) that bulges locally outward from adjoining parts of the peripheral wall.

Thereby, the gap can be created without substantially increasing the overall size of the head cover main body.

Preferably, the bulging part is provided with a boss (41C) having a hole for receiving a fastener that fastens the head cover main body to the cylinder head.

The bulging part can be utilized as a base part for increasing the mechanical stability of the boss so that the bulging part can serve both as a reinforcement for the boss and as the part of the peripheral wall defining the gap.

Preferably, the upper wall of the head cover main body is provided with a pair of ribs (69) projecting from a lower surface thereof and extending substantially orthogonally to a lengthwise direction of the breather chamber to the boss on either side of the second communication hole.

The ribs also contribute to the prevention of oil being thrown into the second communication hole. The ribs have an additional function of increasing the stiffness of the head cover main body. The ribs may extend along the side wall of the downwardly recessed part to further enhance the advantages of the ribs.

According to a preferred embodiment of the present invention, a camshaft (46) extends in the cylinder row direction in the valve actuation chamber, and the second communication hole is offset from any of cams of the camshaft with respect to the cylinder row direction.

Thereby, the oil splashed radially outward from the cams of the camshaft is prevented from entering the breather chamber via the second communication hole.

Preferably, the second communication hole is positioned so as to substantially align with the oil return passage (38).

Thereby, the oil that may be drained from the second communication hole from the breather chamber can be quickly dropped into the oil return passage.

Preferably, the first communication hole is formed with a guide plate (66) extending horizontally at a lower end of the first communication hole.

Thereby, the oil thrown up in the valve actuation chamber is prevented from entering the breather chamber via the first communication hole.

Preferably, the breather chamber is provided with a bottom surface which is slanted downward toward the first end of the breather chamber, and toward one side of the breather chamber, the upstream breather passage opening out on the one side of the breather chamber on the first end of the breather chamber while the first communication hole opens out on another side of the breather chamber on the first end of the breather chamber.

Thereby, the oil that may accumulate in the breather chamber can be readily drained via the upstream breather passage. In case the upstream breather chamber is blocked by the oil rising from the oil reservoir, the oil can be favorably drained via the first communication hole.

In a preferred embodiment of the present invention, the breather chamber includes a first gas liquid separation chamber (54) extending from the first end in the cylinder row direction, and a second gas liquid separation chamber (55) having one end connected to an end of the first gas liquid separation chamber remote from the first end via a PCV valve (60) and extending from the one end thereof to the second end of the breather chamber in parallel with the first gas liquid separation chamber, the first communication hole and the second communication hole communicating the first gas liquid separation chamber with the valve actuation chamber.

Since the breather chamber includes two parts that extend in parallel to each other in the cylinder row direction, the flow path of the blow-by gas can be extended in a space efficient manner so that the oil in the blow-by gas can be favorably separated as the blow-by gas flows along the extended flow path without increasing the size of the head cover main body.

The present invention thus provides a breather device of an internal combustion engine that can prevent the oil in the oil reservoir from rising upward in the breather passage, and prevent the oil splash in the valve actuation chamber from entering the breather chamber along with gas, at the same time.

BRIEF DESCRIPTION OF THE DRAWING(S)

DESCRIPTION OF THE PREFERRED EMBODIMENT(S)

A preferred embodiment of the present invention is described in the following with reference to the appended drawings.

Figure 1:
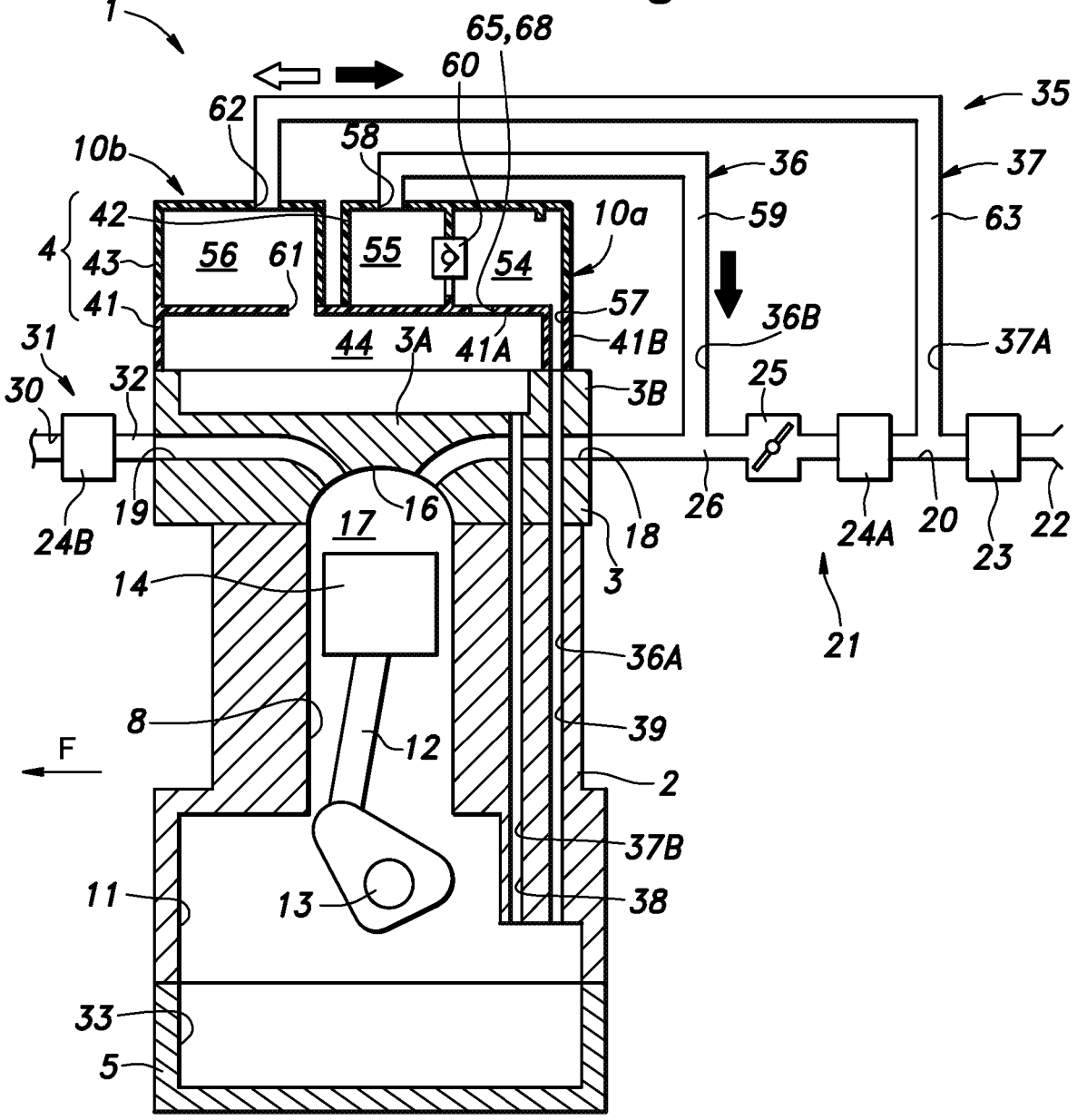
FIG. 1 is a schematic diagram of an internal combustion engine provided with a breather device according to an embodiment of the present invention.

The internal combustion engine 1 according to the present embodiment consists of an in-line, four-cylinder reciprocating engine. As shown in FIG. 1, the internal combustion engine 1 includes a cylinder block 2, a cylinder head 3 coupled to an upper end of the cylinder block 2, a head cover 4 coupled to an upper end of the cylinder head 3, and an oil pan 5 coupled to a lower end of the cylinder block 2. The head cover 4 is internally provided with a pair of oil separation devices 10 (10*a* and 10*b*) for removing oil from the gas circulating within the engine 1 such as blow-by gas.

The cylinder block 2 internally defines four cylinders 8. The cylinders 8 are arranged in a single row extending along a direction which may be defined as a cylinder row direction, and slightly tilt rearward. The cylinder axial lines are described as extending in the vertical direction in the following disclosure for the convenience of description. Since the engine is mounted laterally on the vehicle, the cylinder row direction may also be referred to as a lateral direction. In the illustrated embodiment, the front side of the engine 1 corresponds to the exhaust side of the engine, and the rear side of the engine corresponds to the intake side of the engine. The cylinders 8 are named a first, a second, a third and a fourth cylinder in that order from the left side to the right side from the view point of the vehicle driver.

The upper end of each cylinder 8 opens out at the upper surface of the cylinder block 2, and the lower end of the cylinder 8 communicates with a crank chamber 11 formed in the lower part of the cylinder block 2 in cooperation with the oil pan 5. A piston 14 connected to the crankshaft 13 via a connecting rod 12 is slidably received in each cylinder 8. The axis of the crankshaft 13 extends in the lateral direction.

Figure 3:
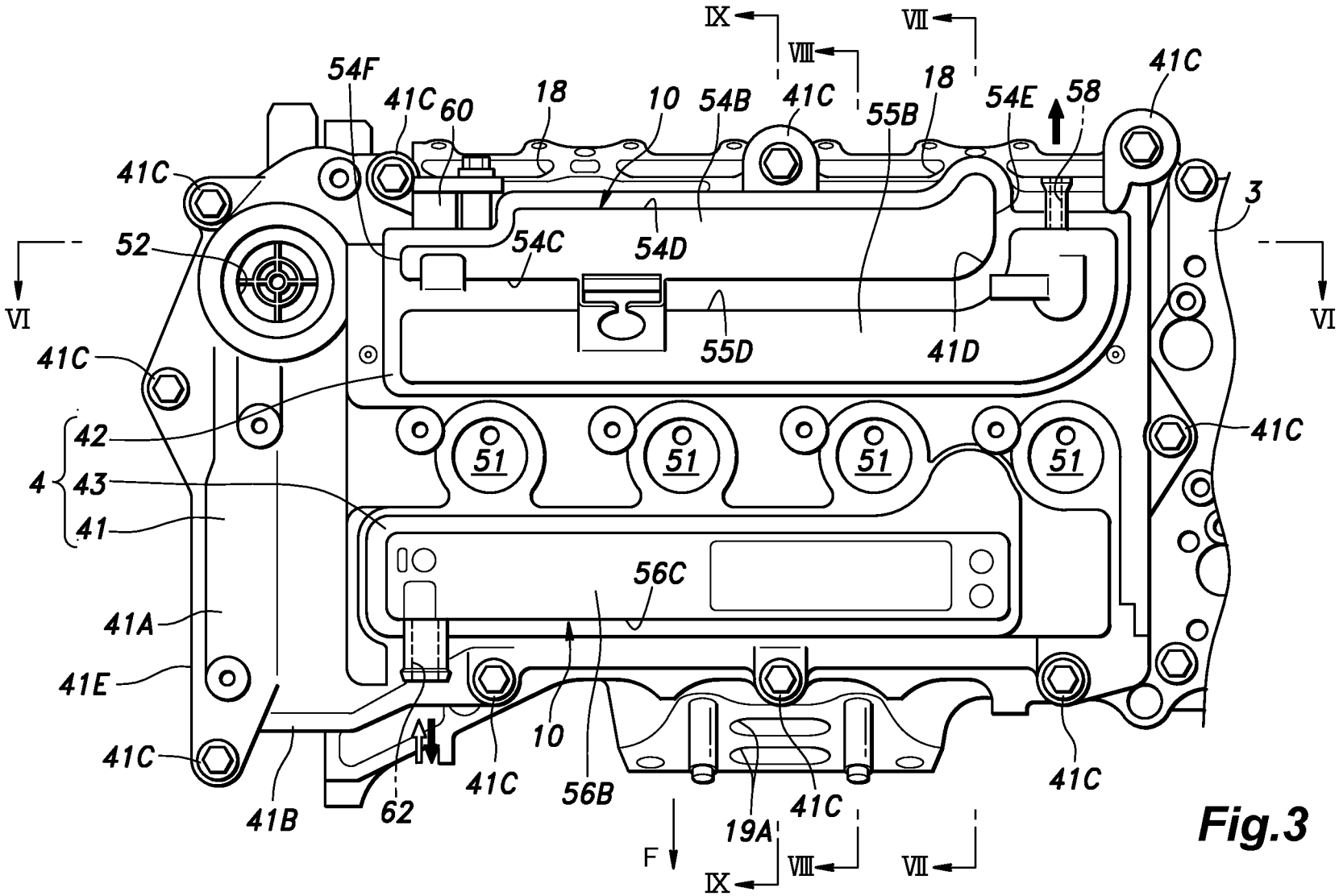
FIG. 3 is a plan view of the internal combustion engine.

The cylinder head 3 extends in the cylinder row direction, and is provided with four combustion chamber recesses 16 in positions corresponding to the respective cylinders 8 on the lower surface thereof. Each combustion chamber recess 16 forms a combustion chamber 17 in cooperation with the cylinder 8. An intake port 18 extends from each combustion chamber recess 16 to the rear side of the cylinder head 3 and an exhaust port 19 extends from the combustion chamber recess 16 to the front side of the cylinder head 3. In the illustrated embodiment, the cylinder head 3 is internally incorporated with an exhaust manifold 32, and a common outlet end 19A of the exhaust manifold 32 opens out at the front side of the cylinder head 3 as shown in FIG. 3.

As shown in FIG. 1, the internal combustion engine 1 is provided with an intake system 21 that defines an intake passage 20 provided with an air inlet 22, an air cleaner 23, a turbocharger compressor 24A, a throttle valve 25, and an intake manifold 26 in that order from the upstream side. The intake manifold 26 is coupled to the cylinder head 3 and communicates with the intake ports 18. The exhaust system 31 of the internal combustion engine 1 defines an exhaust passage 30 provided with, in addition to the exhaust manifold 32, a turbocharger turbine 24B, a catalytic converter (not shown in the drawings), a muffler (not shown in the drawings), and an exhaust outlet (not shown in the drawings) in that order from the upstream side.

The oil pan 5 is formed in a box shape having an open upper end, and is coupled to a lower portion of the cylinder block 2 to form an oil reservoir 33.

The internal combustion engine 1 is provided with a breather device 35 that recirculates the blow-by gas produced in the crank chamber 11 to the intake passage 20 by using the intake negative pressure. The breather device 35 includes a breather passage 36 for communicating the crank chamber 11 with the intake manifold 26 which is connected to a part of the intake passage 20 downstream of the throttle valve 25 as will be described hereinafter. Further, in order to introduce fresh air into the crank chamber 11, the breather device 35 is provided with a fresh air introduction passage 37 for communicating the crank chamber 11 with a part of the intake passage 20 upstream of the throttle valve 25 (in particular between the air cleaner 23 and the compressor 24A) as will be described herein after. The first oil separation device 10*a* is provided in the breather passage 36, and the second oil separation device 10*b* is provided in the fresh air introduction passage 37.

An upstream part of the breather passage 36 which is referred to as an upstream breather passage 36A is formed by the cylinder block 2, the cylinder head 3 and the head cover 4, and extends from the crank chamber 11 to the first oil separation device 10*a*. A downstream part of the breather passage 36 which is referred to as downstream breather passage 36B is formed by a blow-by gas discharge pipe 59 consisting of a hose or a pipe, and extends from the first oil separation device 10*a* to the intake passage 20.

An upstream part of the fresh air introduction passage 37 which is referred to as an upstream fresh air introduction passage 37A formed by a fresh air supply pipe 63 consisting of a hose or pipe extends from the intake passage 20 to the second oil separation device 10*b*. A downstream part of the fresh air introduction passage 37 which is referred to as a downstream fresh air introduction passage 37B is formed by the cylinder block 2 and the cylinder head 3, and extends from the second oil separation device 10*b* to the crank chamber 11.

Figure 5:
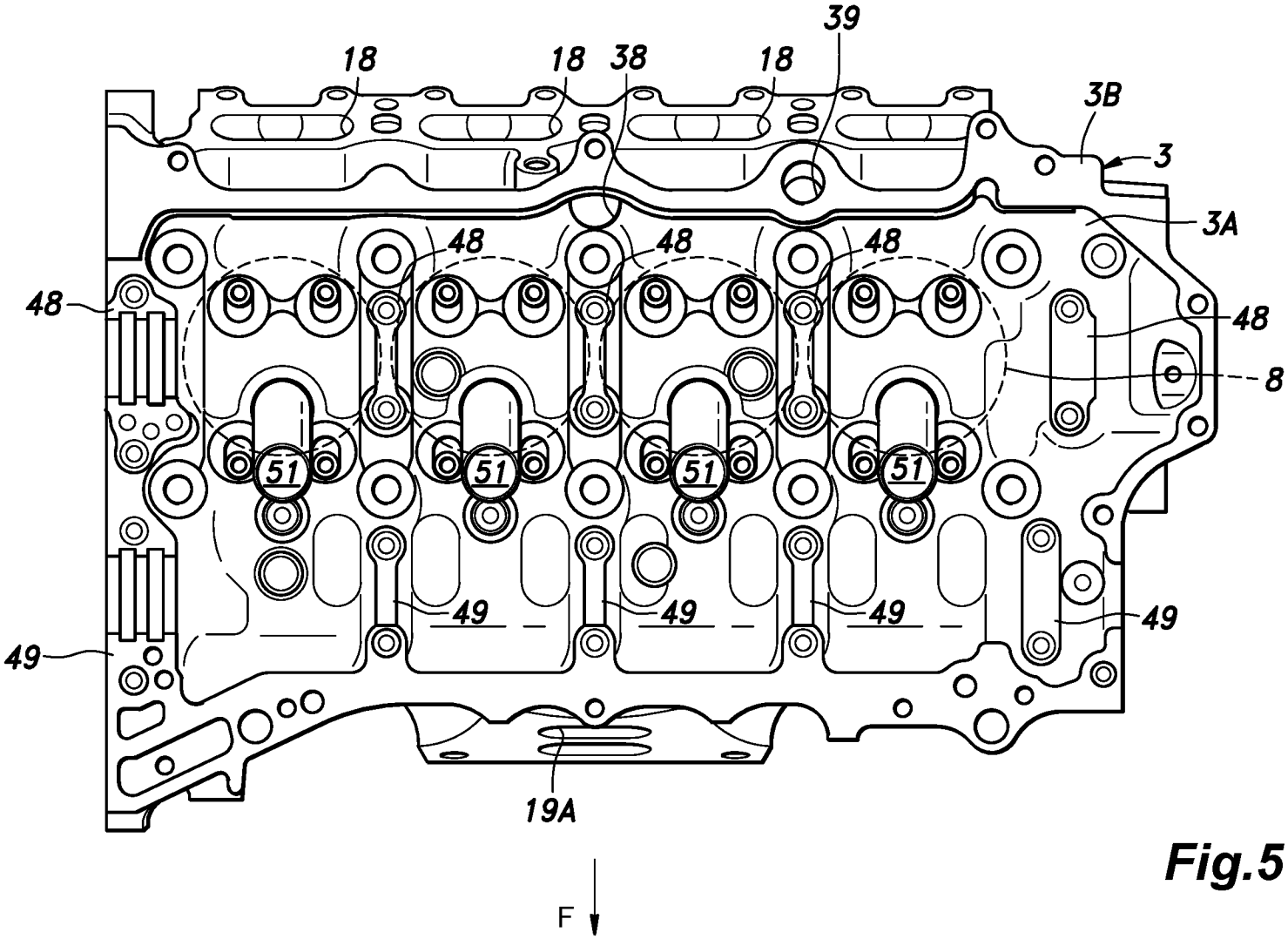
FIG. 5 is a plan view of a cylinder head of the internal combustion engine.

As shown in FIG. 5 also, the cylinder head 3 includes a head main body 3A defining the intake port 18 and the exhaust ports 19, and a head peripheral wall 3B extending upward from the peripheral edge of the head main body 3A and extending along the peripheral edge so that a chamber having an open top is defined thereby. The cylinder block 2 and the cylinder head 3 are formed with an oil return passage 38 and a blow-by gas passage 39 which extend vertically from the upper side of the cylinder head 3 to the interior of the crank chamber 11.

The oil return passage 38 is located between the second cylinder 8 and the third cylinder 8, and has an upper end that opens out at the rear end of the upper surface of the head main body 3A immediately at the base of the adjoining part of the head peripheral wall 3B. The oil collected on the upper surface of the cylinder head 3 can be returned to the crank chamber 11 and the oil reservoir 33 via the oil return passage 38. The oil return passage 38 also functions as a downstream fresh air introduction passage 37B. The blow-by gas passage 39 is located between the first and second cylinders 8, and is disposed further rearward than the first and second cylinders 8, and opens out at the upper surface of the head peripheral wall 3B. The blow-by gas produced in the crank chamber 11 can pass through the blow-by gas passage 39 to be discharged out of the internal combustion engine 1.

Figure 2:
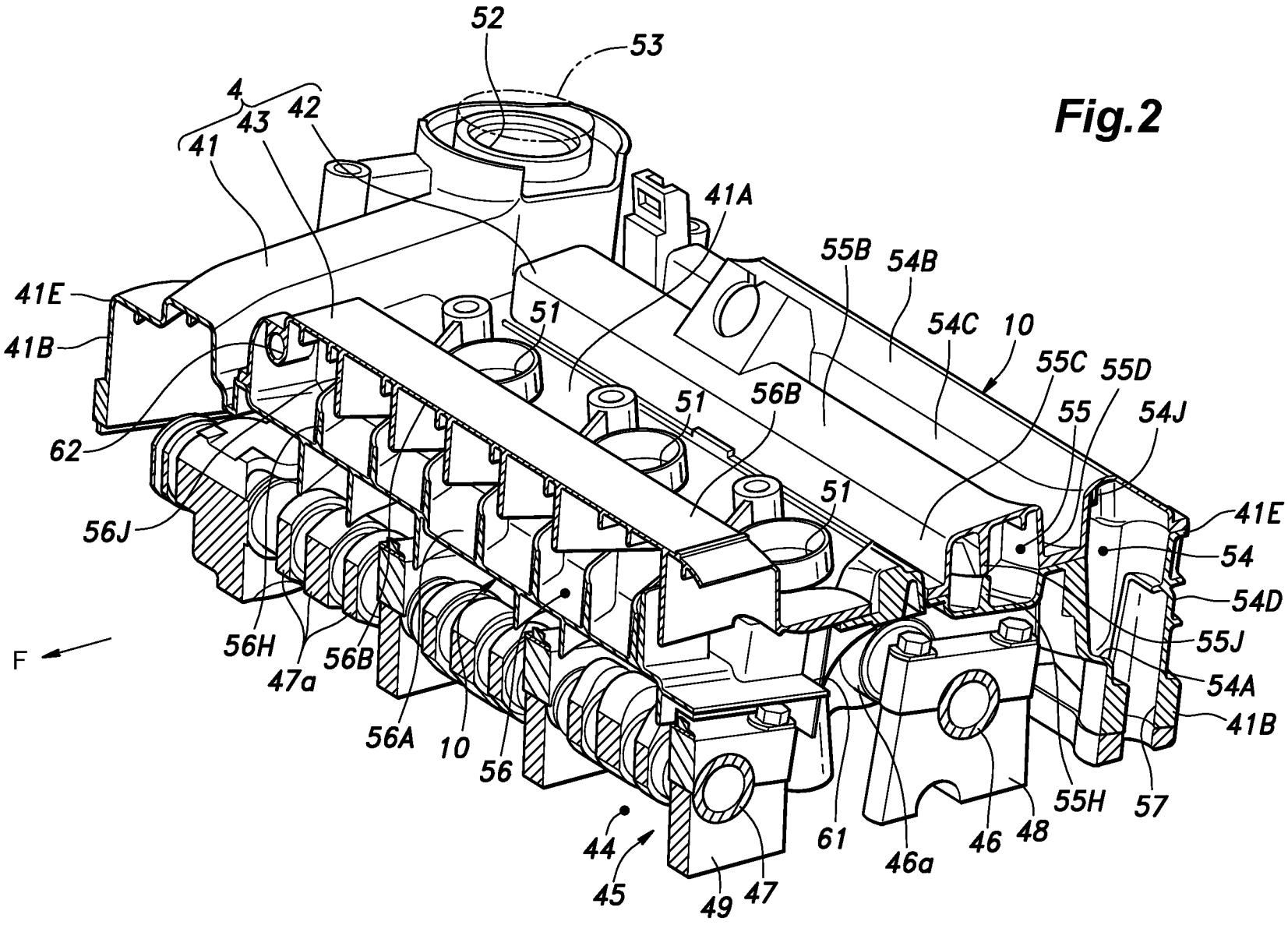
FIG. 2 is a fragmentary perspective view showing a main part of the internal combustion engine partly in section.
Figure 4:
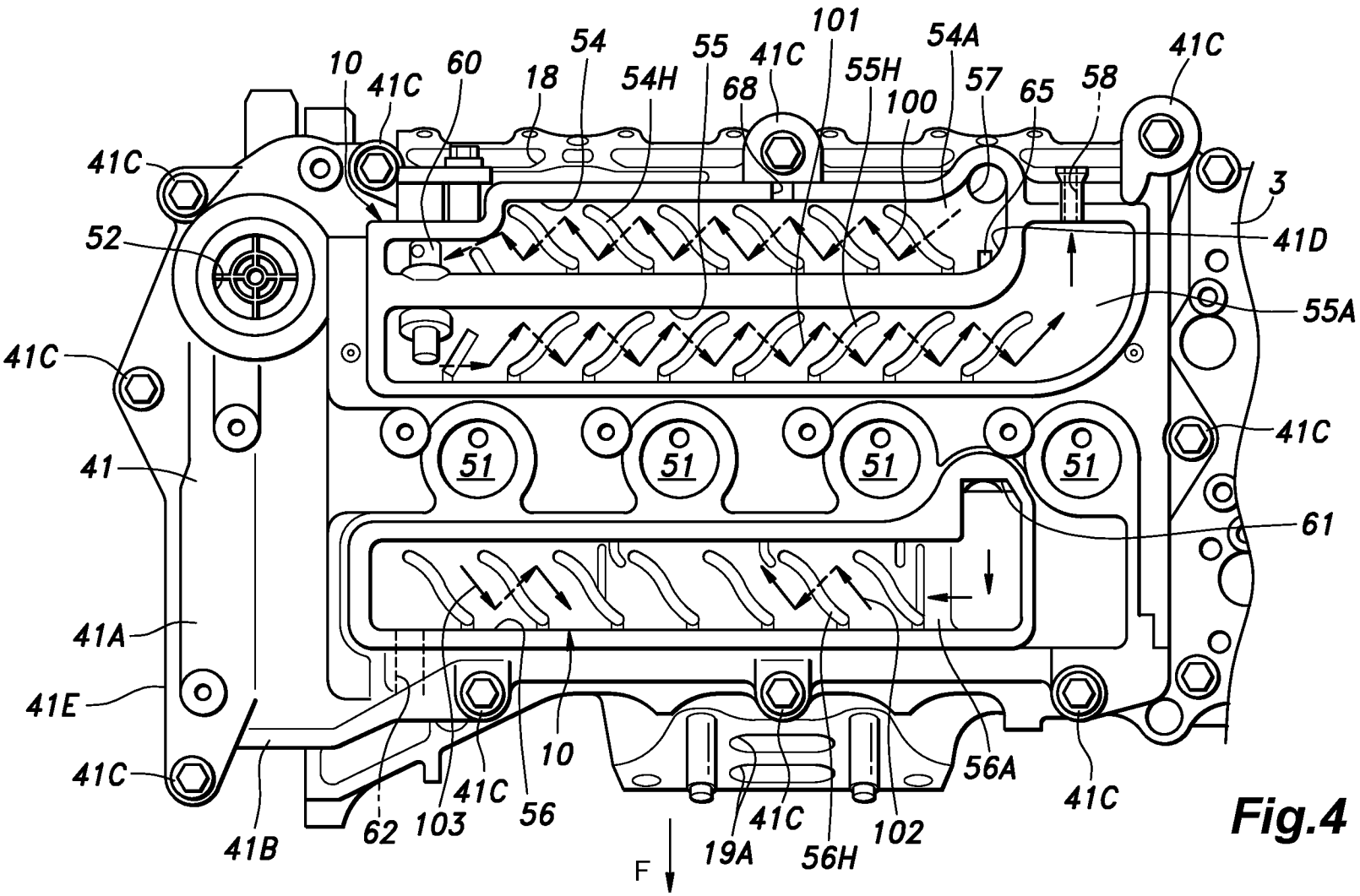
FIG. 4 is a plan view of the internal combustion engine with first and second chamber forming members removed.

As shown in FIGS. 2 to 4, the head cover 4 includes a head cover main body 41, a first chamber forming member 42 attached to the upper side of the head cover main body 41 to define a chamber jointly with the head cover main body 41, and a second chamber forming member 43 attached to the upper side of the head cover main body 41 to define a chamber jointly with the head cover main body 41. In an alternate embodiment, the first chamber forming member 42 and the second chamber forming member 43 may be attached to the lower side of the head cover main body 41.

The head cover main body 41 is provided with an upper wall 41A, and a peripheral wall 41B depending from the peripheral edge 41E of the upper wall 41A and extending along the peripheral edge 41E so that a chamber having an open bottom is defined thereby. The peripheral wall 41B is annular in the illustrated embodiment, but may also be limited to the front and rear edges of the upper wall 41A. The peripheral wall 41B is provided with a plurality of fastening bosses 41C bulging outward and fastened to the cylinder head 3 by stud bolts projecting from the cylinder head 3. The fastening bosses 41C are formed in at least at six positions along the front and rear edges of the head cover main body 41. Additionally, three fastening bosses 41C are provided along the right edge of the head cover main body 41, and one fastening bosses 41C is provided on the left edge of the head cover main body 41. When the fastening bosses 41C are fastened to the cylinder head 3 by the corresponding stud bolts, the peripheral wall 41B of the head cover main body 41 abuts the peripheral part of the cylinder head 3 via a seal member 40 (see FIGS. 7 and 11). The head cover main body 41 covers at least a part of the upper surface of the cylinder head 3, and defines valve actuation chamber 44 jointly with the cylinder head 3.

Figure 7:
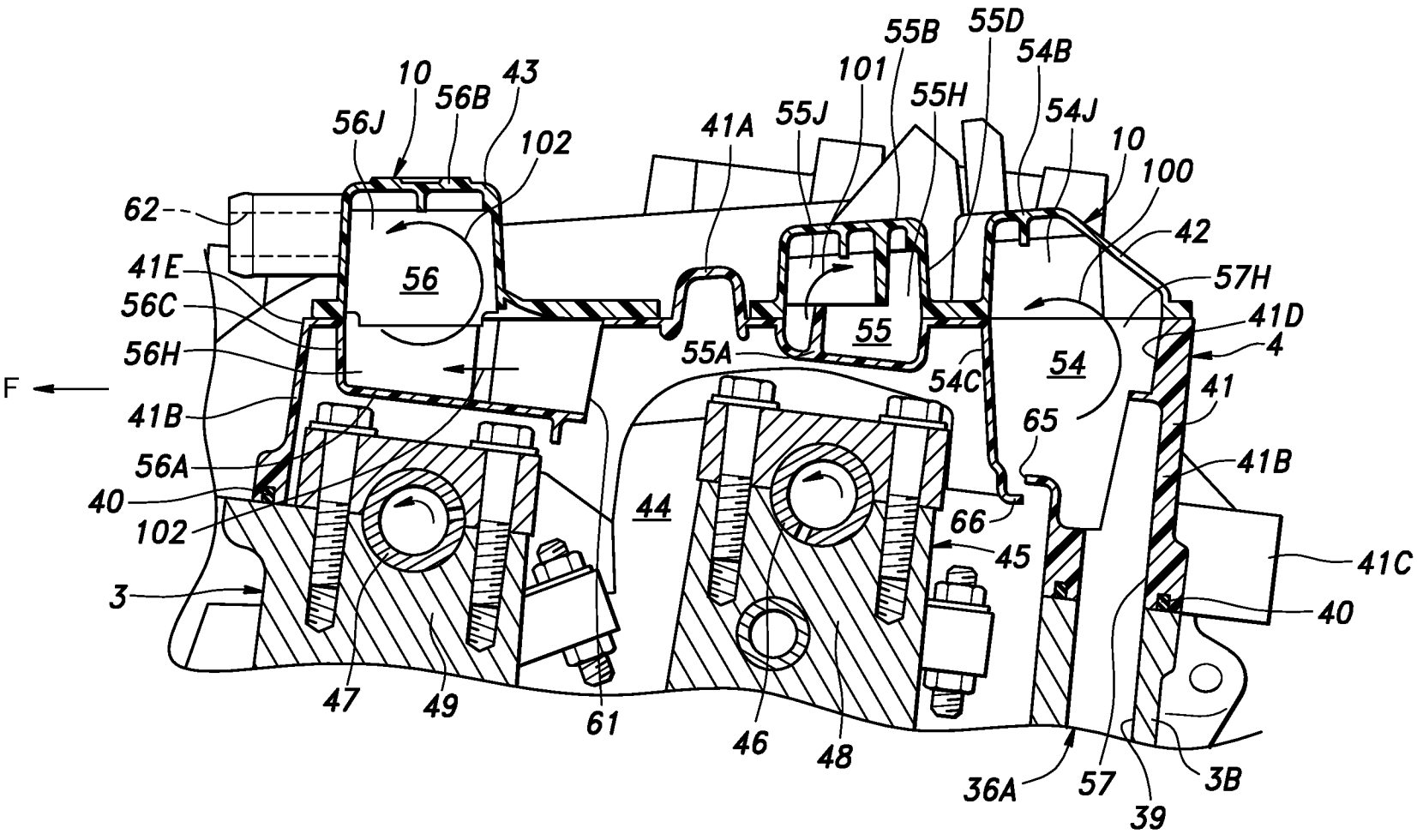
FIG. 7 is a sectional view taken along line VII-VII of FIG. 3.
Figure 8:
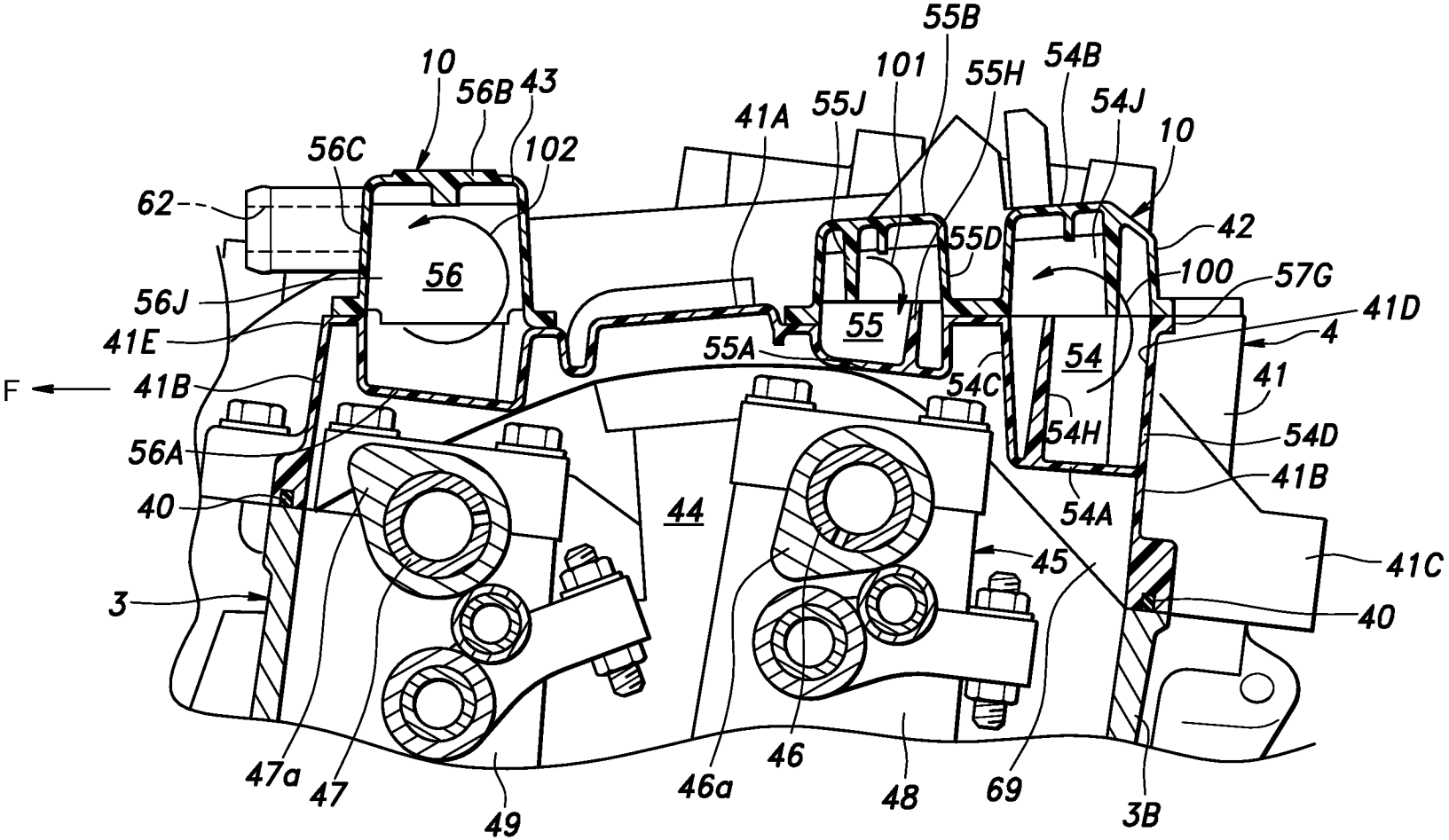
FIG. 8 is a sectional view taken along line VIII-VIII of FIG. 3.

As shown in FIGS. 2, 7, and 8, the valve actuation chamber 44 accommodates a per se known valve actuation mechanism 45. The valve actuation mechanism 45 includes an intake camshaft 46 extending along a rear part of the valve actuation chamber 44 in the cylinder row direction, and an exhaust camshaft 47 extending along a front part of the valve actuation chamber 44 in the cylinder row direction. The intake camshaft 46 is provided with four sets of cams 46*a* corresponding to the respective cylinders 8, and is rotatably supported by the cylinder head 3 via five intake cam holders 48. The intake camshaft 46 drives the intake valves via intake rocker arms. The exhaust camshaft 47 is provided with four sets of cams 47*a* corresponding to the respective cylinders 8, and is rotatably supported by the cylinder head 3 via five exhaust cam holders 49. The exhaust camshaft 47 drives the exhaust valves via exhaust rocker arms. Each set of cams may include a plurality of cam profiles for variably driving the corresponding intake or exhaust valve or valves.

As shown in FIGS. 2 to 4, spark plug holes 51 for inserting spark plugs are passed through the upper wall 41A of the head cover main body 41 at positions corresponding to the combustion chamber recesses 16 formed in the cylinder head 3. The spark plug holes 51 are numbered as first, second, third and fourth in that order from the left side so as to correspond to the numbering of the cylinders 8.

An oil filler hole 52 is formed in a part of the upper wall 41A of the head cover main body 41 on the right rear side of the fourth spark plug hole 51. An oil filler cap 53 (FIG. 2) is detachably attached to the oil filler hole 52. When refilling the oil, the user removes the oil filler cap 53 and pours oil into the oil filler hole 52. The oil poured into the oil filler hole 52 flows onto the upper surface of the cylinder head 3, and then flows downward through the oil return passage 38 to the oil reservoir 33.

A first gas liquid separation chamber 54 and a second gas liquid separation chamber 55 are defined between the upper wall 41A of the head cover main body 41 and the first chamber forming member 42, and a third gas liquid separation chamber 56 is defined between the upper wall 41A of the head cover main body 41 and the second chamber forming member 43. In other words, the first chamber forming member 42 and the second chamber forming member 43 define the first to third gas liquid separation chambers 54-56 jointly with the head cover main body 41. The first gas liquid separation chamber 54 and the second gas liquid separation chamber 55 communicate with each other so as to form serial breather chambers that act as the first oil separation device 10*a*. The third gas liquid separation chamber 56 forms a breather chamber that act as the second oil separation device 10*b*.

The first gas liquid separation chamber 54 and the second gas liquid separation chamber 55 extend in the lateral direction behind the spark plug holes 51, or on the intake side. The second gas liquid separation chamber 55 is located directly above the intake camshaft 46, while the first gas liquid separation chamber 54 is located behind the intake cam holders 48 (see FIGS. 7 to 9). The left end of the second gas liquid separation chamber 55 is bent rearward along the left end of the first gas liquid separation chamber 54 so that the second gas liquid separation chamber 55 has the shape of letter L in plan view.

The third gas liquid separation chamber 56 extends in the lateral direction on the front side of the spark plug holes 51, or directly above the exhaust camshaft 47 on the exhaust side. The left end of the third gas liquid separation chamber 56 extends rearwards into the space defined between the first spark plug hole 51 and the second spark plug hole 51 so that the third gas liquid separation chamber 56 has the shape of letter L in plan view.

As shown in FIGS. 4 and 7, the left end of the upper wall 41A of the head cover main body 41 defining an end of the first gas liquid separation chamber 54 is formed with a gas inlet hole 57 communicating with the blow-by gas passage 39. The gas inlet hole 57 is positioned between the first spark plug hole 51 and the second spark plug hole 51 with respect to the lateral direction. The gas inlet hole 57 is formed in a part of the rear end of the upper wall 41A adjacent to the base of the peripheral wall 41B of the head cover main body 41, and extends downward in continuation to the upper end of the blow-by gas passage 39. The blow-by gas passage 39 and the gas inlet hole 57 jointly form the upstream breather passage 36A which communicates the left end side of the first gas liquid separation chamber 54 with the crank chamber 11.

A first communication hole 65 and a second communication hole 68 are formed in parts of the first gas liquid separation chamber 54 for communicating the first gas liquid separation chamber 54 with the valve actuation chamber 44, as will be discussed in greater detail later.

A gas outlet hole 58 (see FIG. 4) is formed in a left end part of a rear wall 55D of the second gas liquid separation chamber 55. As shown in FIG. 1, the gas outlet hole 58 is communicated with a part of the intake passage 20 downstream of the throttle valve 25 or in a part of the intake manifold 26 via the blow-by gas discharge pipe 59 forming the downstream breather passage 36B. As indicated by the solid arrows in FIGS. 1 and 3, the gas outlet hole 58 functions as a blow-by gas discharge hole for discharging the blow-by gas from the second gas liquid separation chamber 55 to the intake system 21.

As shown in FIGS. 1, 3 and 4, a PCV valve 60 is passed through a right end part of a wall disposed between the first gas liquid separation chamber 54 and the second gas liquid separation chamber 55. The PCV valve 60 includes a housing defining a valve passage communicating the first gas liquid separation chamber 54 with the second gas liquid separation chamber 55, a valve seat provided in the valve passage and facing the second gas liquid separation chamber 55, a valve member configured to be seated on the valve seat, and a spring member urging the valve member toward the valve seat. The PCV valve 60 is closed in the initial state with the valve member seated on the valve seat under the biasing force of the spring member. When the pressure on the side of the second gas liquid separation chamber 55 is lower than the pressure on the side of the first gas liquid separation chamber 54 by a prescribed amount, the valve member is lifted from the valve seat against the biasing force of the spring member, thereby opening the PCV valve 60 to permit the flow of gas from the first gas liquid separation chamber 54 to the second gas liquid separation chamber 55. In other words, the PCV valve 60 adjusts the flow rate of the blow-by gas in dependence on the pressure difference between the first gas liquid separation chamber 54 and the second gas liquid separation chamber 55.

As shown in FIGS. 4 and 7, a part of the head cover main body 41 located between the first spark plug hole 51 and the second spark plug hole 51 with respect to the lateral direction is formed with a vent hole 61 which is passed through the upper wall 41A so as to communicate the upper side of the upper wall 41A with the valve actuation chamber 44. The vent hole 61 opens rearward at the rear end of the right end of the third gas liquid separation chamber 56 located directly above the second exhaust cam holder 49 from the left.

A gas flow port 62 is formed in an upper part (the second chamber forming member 43) of the right end of the front wall 56C of the third gas liquid separation chamber 56. As shown in FIG. 1, the gas flow port 62 is connected to a part of the intake passage 20 located between the air cleaner 23 and the compressor 24A via the upstream fresh air introduction passage 37A formed by a fresh air supply pipe 63. As indicated by the white arrow in FIGS. 1 and 3, the gas flow port 62 functions as a fresh air introduction port for introducing fresh air from the intake system 21 to the third gas liquid separation chamber 56. The gas flow port 62 additionally functions as a blow-by gas discharge port for discharging the blow-by gas from the third gas liquid separation chamber 56 to the intake system 21 as indicated by the black arrow in FIGS. 1 and 3.

As shown in FIGS. 4, and 6 to 8, the first gas liquid separation chamber 54 is defined by a lower wall 54A, an upper wall 54B, a front wall 54C, a rear wall 54D, a left wall 54E and a right wall 54F. The lower wall 54A of the first gas liquid separation chamber 54 is formed by the upper wall 41A of the head cover main body 41, and is recessed downward relative to the general upper surface of the upper wall 41A so as to define a recessed part 41D jointly with the side walls such as the front wall 54C, the rear wall 54D, the left wall 54E and the right wall 54F. The lower wall 54A of the first gas liquid separation chamber 54 slants downward toward the left side and toward the rear side. The upper wall 54B of the first gas liquid separation chamber 54 is formed by the first chamber forming member 42. The rear wall 54D, the left wall 54E and the right wall 54F of the first gas liquid separation chamber 54 are formed by the head cover main body 41 and the first chamber forming member 42.

A plurality of (six, in the embodiment illustrated in FIG. 6) lower slanted deflection plates 54H project upward from the upper surface of the lower wall 54A of the first gas liquid separation chamber 54. Each lower slanted deflection plate 54H is provided with a predetermined length in the horizontal direction. The lower slanted deflection plates 54H are arranged in parallel to each other in plan view, and are arranged at a substantially regular interval in the lateral direction. Each lower slanted deflection plate 54H is inclined in a first direction with respect to the lateral direction in plan view. More specifically, each lower slanted deflection plate 54H extends in the first direction which is inclined leftward toward the front part thereof, and is oriented in such manner that the front end thereof is located to the left side with respect to the rear end thereof.

The rear edge of each lower slanted deflection plate 54H is spaced from the rear wall 54D of the first gas liquid separation chamber 54 defining a gap therebetween. On the other hand, the front edge of each lower slanted deflection plate 54H is connected to the front wall 54C of the first gas liquid separation chamber 54. The upper edge of each lower slanted deflection plate 54H is at a prescribed height located between the lower wall 54A and the upper wall 54B.

A plurality of (six, in the embodiment illustrated in FIG. 6) upper slanted deflection plates 54J project downward from the lower surface of the upper wall 54B of the first gas liquid separation chamber 54. Each upper slanted deflection plate 54J is provided with a predetermined length in the horizontal direction. The upper slanted deflection plates 54J are arranged in parallel to each other in plan view, and are arranged at a substantially regular interval in the lateral direction. Each upper slanted deflection plate 54J is inclined in a second direction opposite to the first direction with respect to the lateral direction in plan view. More specifically, each upper slanted deflection plate 54J extends in the second direction which is inclined rightward toward the front part thereof, and is oriented in such a manner that the front end thereof is located to the right side with respect to the rear end thereof. Therefore, the first direction and the second direction are symmetric to each other with respect to a laterally extending axis.

Figure 6:
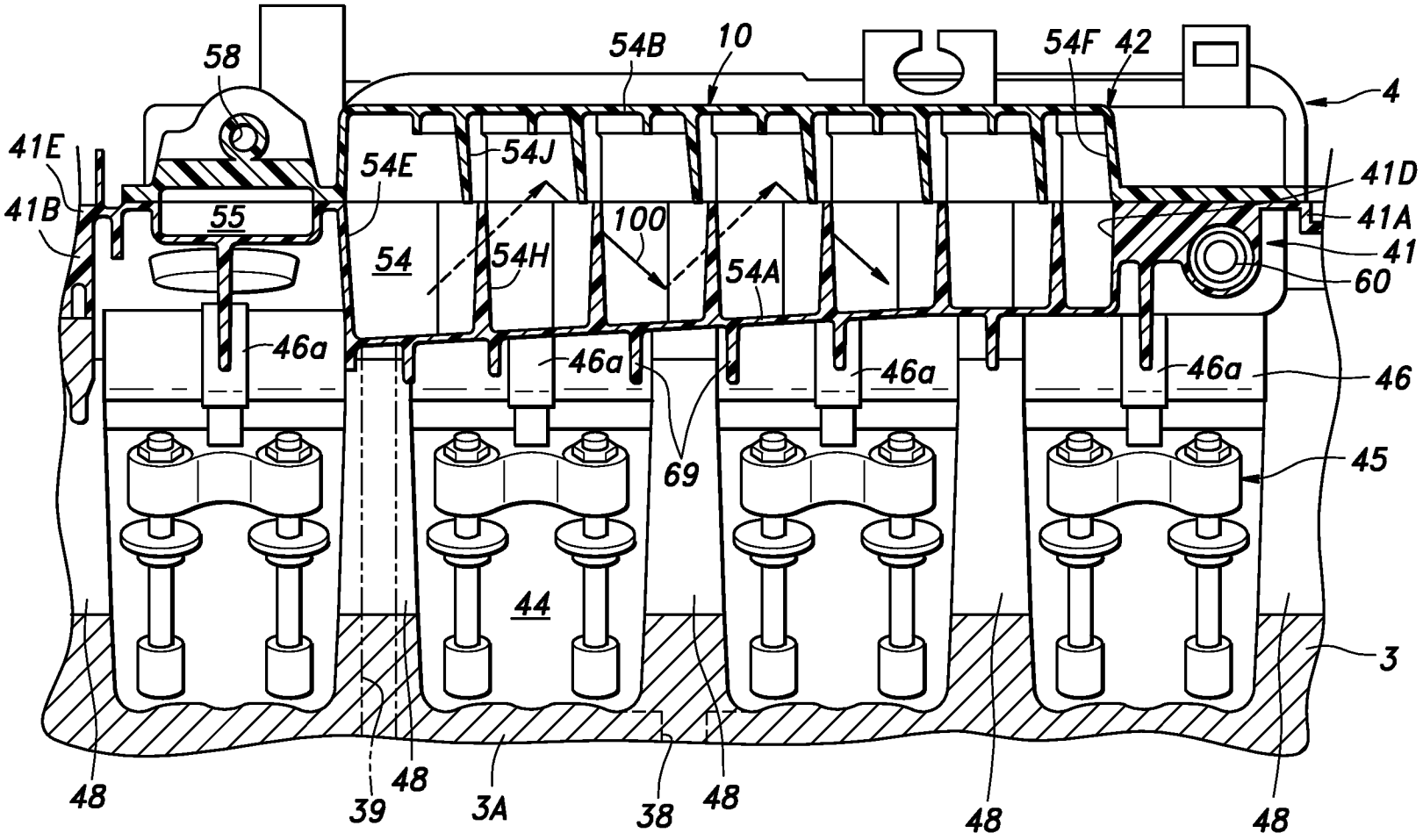
FIG. 6 is a sectional view taken along line VI-VI of FIG. 3.

The rear edge of each upper slanted deflection plate 54J is connected to the rear wall 54D of the first gas liquid separation chamber 54. The front edge of each upper slanted deflection plate 54J is connected to the front wall 54C of the first gas liquid separation chamber 54. The length of each upper slanted deflection plate 54J in the vertical direction is about one half of the distance between the lower wall 54A and the upper wall 54B. In plan view, each upper slanted deflection plate 54J intersects at least one of the lower slanted deflection plates 54H. As shown in FIG. 6, the lower end of each upper slanted deflection plate 54J is in contact with the upper end of the corresponding lower slanted deflection plate 54H at the intersection of the upper slanted deflection plate 54J and the lower slanted deflection plate 54H.

As shown in FIGS. 4 and 7, a counterclockwise helical passage is formed in the first gas liquid separation chamber 54 by the upper slanted deflection plates 54J and the lower slanted deflection plates 54H as viewed toward the right direction or in the direction of a blow-by gas flow. As a result, when the gas flows from the gas inlet hole 57 to the PCV valve 60, as indicated by arrows 100 in FIGS. 4 and 6, the gas flows leftward and forward along the upper slanted deflection plates 54J, downward along the front wall 54C, leftward and rearward along the lower slanted deflection plates 54H, and upward along the rear wall 54D. As the blow-by gas flows along this spiral path, oil contained in the blow-by gas is separated. The separated oil flows along the inclined lower wall 54A under gravity, and is returned to the oil reservoir 33 via the gas inlet hole 57 on the left end of the first gas liquid separation chamber 54 and the blow-by gas passage 39.

Similarly, a clockwise helical passage is formed in the second gas liquid separation chamber 55 by a plurality of lower slanted deflection plates 55H projecting from the upper surface of the lower wall 55A and a plurality of upper slanted deflection plates 55J depending from the lower surface of the upper wall 55B as viewed toward the left direction or in the direction of a blow-by gas flow. The lower wall 55A of the second gas liquid separation chamber 55 is inclined downward from the left end to the right end. A right rear end part of the lower wall 55A of the second gas liquid separation chamber 55 located under the PCV valve 60 is provided with an oil discharge hole which is passed through the lower wall 55A. The oil discharge hole communicates the second gas liquid separation chamber 55 with the valve actuation chamber 44 so that the oil separated from the blow-by gas in the second gas liquid separation chamber 55 is returned to the oil reservoir 33 via the oil discharge hole, the valve actuation chamber 44 and the oil return passage 38.

Similarly, a counterclockwise helical passage is formed in the third gas liquid separation chamber 56 by a plurality of lower slanted deflection plates 56H projecting from the upper surface of the lower wall 56A and the upper slanted deflection plates 56J depending from the lower surface of the upper wall 56B as viewed toward the right direction or in the direction of a blow-by gas flow. In the third gas liquid separation chamber 56, depending on the situation, either the fresh air flows from the gas flow port 62 to the vent hole 61 as indicated by the arrows 102 in FIG. 4, or the blow-by gas flows from the vent hole 61 to the gas flow port 62 as indicated by the arrows 103 in FIG. 4. In either case, the gas flow turns in counterclockwise direction in either case. In particular, as the blow-by gas flows along a counterclockwise path in the third gas liquid separation chamber 56, oil is separated from the blow-by gas. Since the lower wall 56A of the third gas liquid separation chamber 56 inclines downward toward the vent hole 61, the separated oil is returned to the oil reservoir 33 via the vent hole 61, the valve actuation chamber 44 and the oil return passage 38.

The mode of flow of the blow-by gas and the fresh air in the internal combustion engine 1 is described in the following. In a low output condition of the internal combustion engine 1, the turbocharger is not in operation. In such a case, as shown in FIGS. 1 and 4, the downstream side of the throttle valve 25 of the intake system 21 is under a negative pressure owing to the downward strokes of the pistons 14 so that the pressure on the downstream side of the throttle valve 25 is lower than the pressure on the upstream side of the throttle valve 25. The negative pressure on the downstream side of the throttle valve 25 is supplied to the second gas liquid separation chamber 55 via the downstream breather passage 36B so that the PCV valve 60 opens. As a result, the blow-by gas in the crank chamber 11 flows through the path passing through the blow-by gas passage 39 and the gas inlet hole 57, and flows into the first gas liquid separation chamber 54. Thereafter, the blow-by gas passes through the PCV valve 60, the second gas liquid separation chamber 55, the gas outlet hole 58, and the downstream breather passage 36B, and is supplied to the intake manifold 26 (see the solid arrow in FIG. 1).

The oil mist contained in the blow-by gas is removed from the blow-by gas by adhering to the wall surface of the passage through which the blow-by gas passes. The oil mist is removed particularly when passing through the first gas liquid separation chamber 54 and the second gas liquid separation chamber 55. In the first gas liquid separation chamber 54 and the second gas liquid separation chamber 55, the blow-by gas flows spirally in the longitudinal direction, so that the oil mist is thrown radially outward by the centrifugal force, and is separated from the blow-by gas by adhering to the surfaces of the lower slanted deflection plates 55H and 56H and the upper slanted deflection plates 55J and 56J as well as the wall surfaces of the chambers.

At the same time as the blow-by gas in the crank chamber 11 is discharged to the intake system 21, fresh air on the upstream side of the throttle valve 25 of the intake system 21 flows into the crank chamber 11 via the upstream fresh air introduction passage 37A, the gas flow port 62, the third gas liquid separation chamber 56, the vent hole 61, the valve actuation chamber 44, and the oil return passage 38 in that order. As a result, the crank chamber 11 is properly ventilated as indicated by the white arrow in FIG. 1.

In a high output condition of the internal combustion engine 1, the turbocharger is in operation so that the pressure of the intake system 21 on the downstream side of the compressor 24A becomes higher than that on the upstream side of the compressor 24A. The positive pressure on the downstream side of the compressor 24A is supplied to the second gas liquid separation chamber 55 via the downstream breather passage 36B, and the PCV valve 60 is closed. As a result, the blow-by gas in the crank chamber 11 does not flow into the blow-by gas passage 39, but, instead, flows through the valve actuation chamber 44, the vent hole 61, the third gas liquid separation chamber 56, the gas flow port 62, and the upstream fresh air introduction passage 37A as indicated by the solid arrow in FIG. 1. In other words, in a high output condition, the blow-by gas flows through the fresh air introduction passage 37 in the opposite direction (whereas the fresh air introduction passage 37 functioned as a passage for introducing fresh air in a lower output condition). At this time, the vent hole 61 in the third gas liquid separation chamber 56 serves as a gas inlet while the gas flow port 62 serves as a gas outlet.

The oil mist contained in the blow-by gas adheres to the wall surface while passing through the fresh air introduction passage 37, so that the oil mist is removed from the blow-by gas. The oil mist is particularly actively removed when passing through the third gas liquid separation chamber 56. In the third gas liquid separation chamber 56, the blow by gas flows spirally in the longitudinal direction, so that the oil mist is thrown radially outward by the centrifugal force, and is separated from the blow by gas by adhering to the surfaces of the lower slanted defection plates 56H and the upper slanted deflection plates 56J as well as the surfaces of the walls 56A to 56F of the third gas liquid separation chamber 56.

As shown in FIGS. 4 and 7, the first communication hole 65 is formed in the front left part of the lower wall 54A of the first gas liquid separation chamber 54 so that the first gas liquid separation chamber 54 is communicated with the valve actuation chamber 44. Owing to the first communication hole 65, even when the amount of the produced blow-by gas is large and the amount of oil separated in the first gas liquid separation chamber 54 is large, the separated oil can be prevented from blocking the upstream breather passage 36A so that the blow-by gas can be passed into the first gas liquid separation chamber 54 without fail.

The part of the lower wall 54A defining the first communication hole 65 is formed with a guide plate 66 extending horizontally at the lower end of the first communication hole 65 so as to bend the lower end of the first communication hole 65 into the horizontal direction. As a result, the lower end of the first communication hole 65 opposes the peripheral wall 41B from a close proximity. Thus, when the first gas liquid separation chamber 54 is placed under a negative pressure, and the air in the valve actuation chamber 44 is drawn from the first communication hole 65, the oil mist dispersed in the air in the valve actuation chamber 44 is prevented from flowing into the first gas liquid separation chamber 54. The first communication hole 65 is located so as to align with the intake cam holder 48 provided between the first cylinder 8 and the second cylinder 8 with respect to the lateral direction, or, in other words, at a position offset from the cams 46*a* of the intake camshaft 46 in the lateral direction and behind the intake cam holder 48. This also contributes to preventing the oil mist or the oil splash from being introduced into the first gas liquid separation chamber 54.

Figure 9:
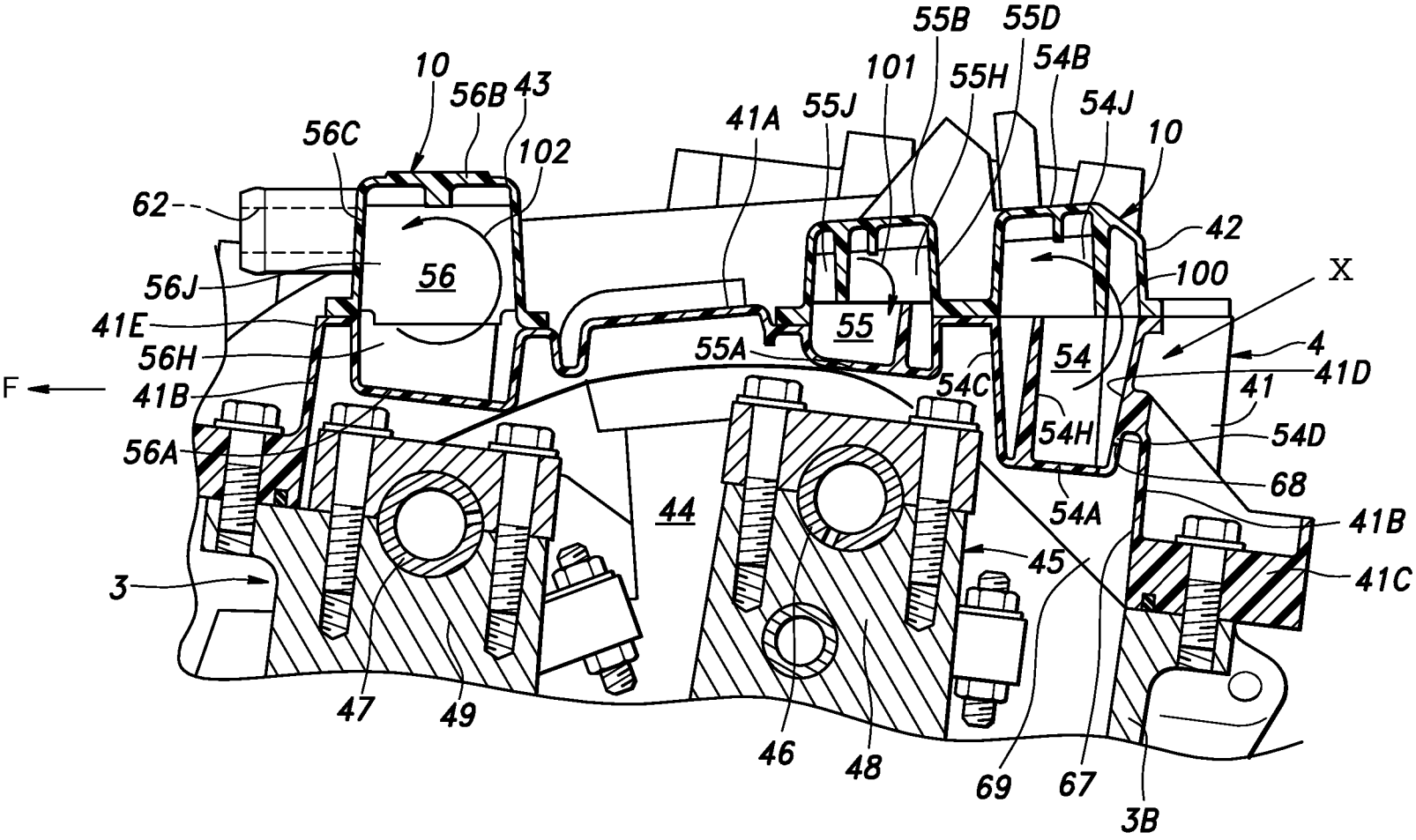
FIG. 9 is a sectional view taken along line IX-IX of FIG. 3.
Figure 11:
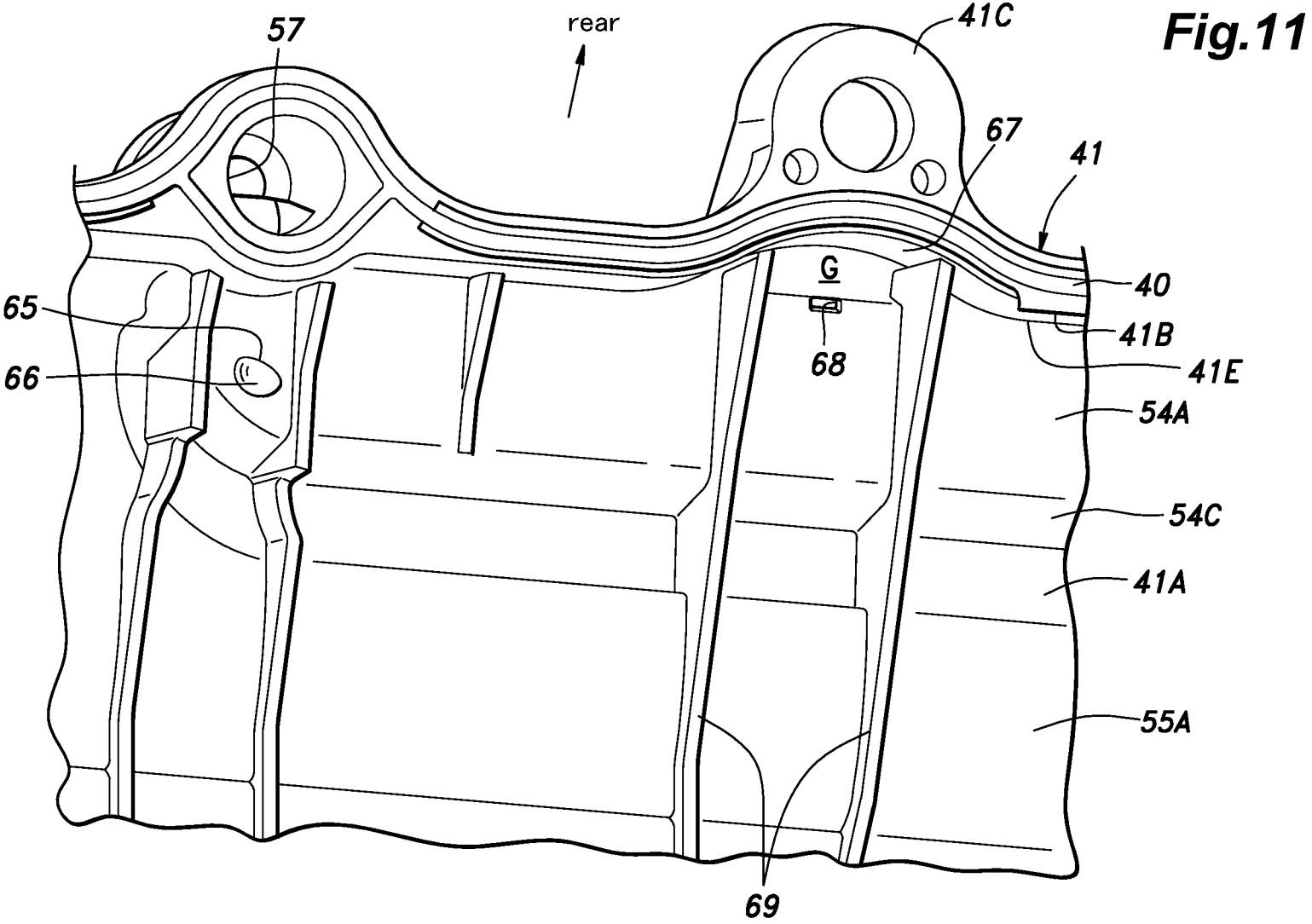
FIG. 11 is a bottom perspective view of a head cover of the internal combustion engine.

As shown in FIG. 8, a lower part of the rear wall 54D of the first gas liquid separation chamber 54 is formed in most part by the peripheral wall 41B of the head cover main body 41. On the other hand, as shown in FIGS. 9 and 11, in the end part of the head cover main body 41 where the fastening boss 41C is disposed between the second cylinder 8 and the third cylinder 8, the peripheral wall 41B bulges rearward so as to define a gap G between the rear wall 54D of the first gas liquid separation chamber 54 and the peripheral wall 41B of the head cover main body 41. In other words, the peripheral wall 41B is provided with a bulging portion 67 that bulges out locally, and the part of the rear wall 54D of the first gas liquid separation chamber 54 where this bulging portion 67 is formed separately from the peripheral wall 41B of the head cover main body 41. The bulging portion 67 defines the gap G which opens downward by expanding the valve actuation chamber 44 upward at the rear end of the first gas liquid separation chamber 54.

Figure 10:
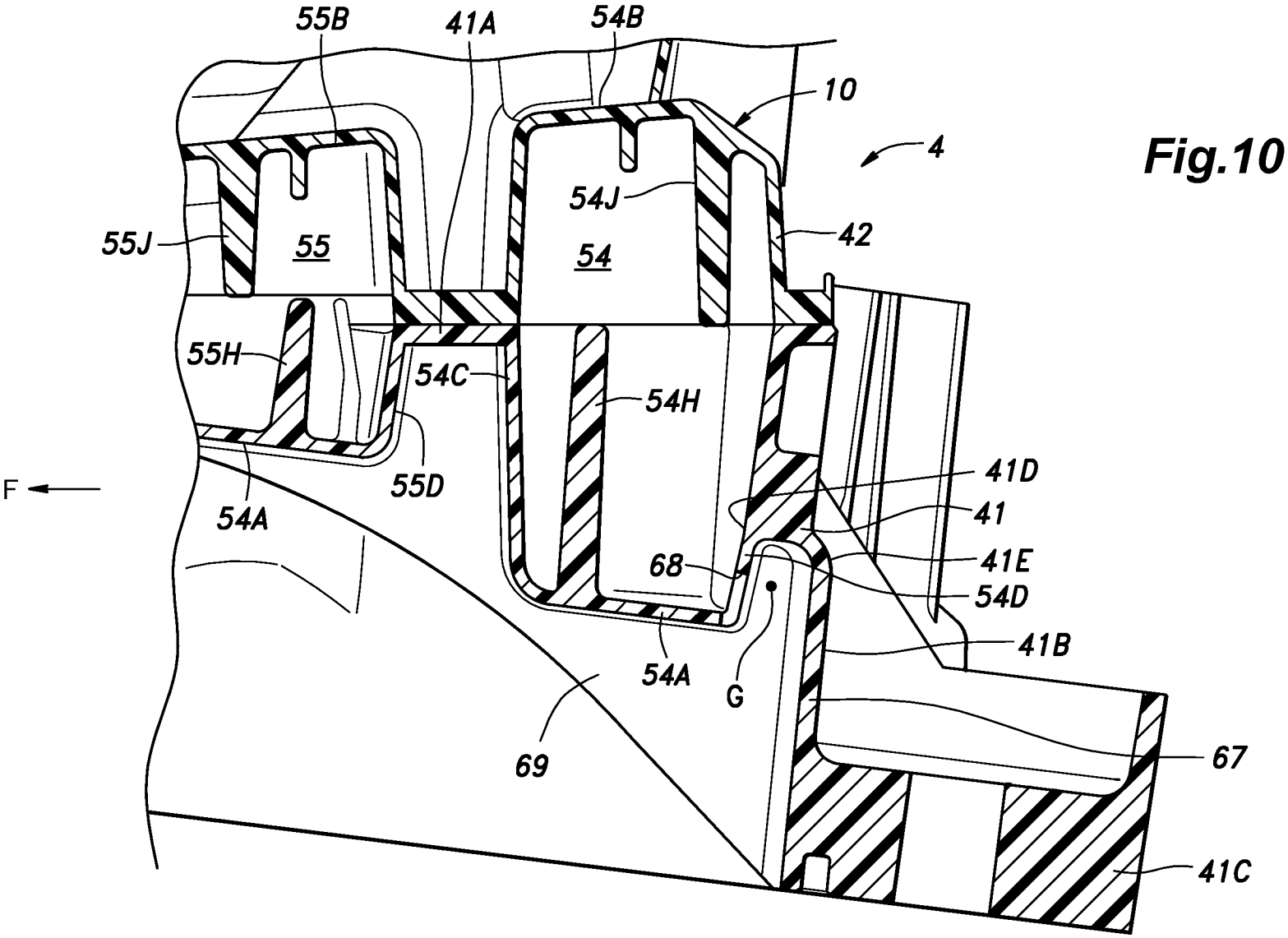
FIG. 10 is a perspective view of a head cover of the internal combustion engine as seen from below.

As shown in FIG. 10 also, the second communication hole 68 is formed in a lower part of the rear wall 54D of the first gas liquid separation chamber 54 opposing the bulging portion 67 so that the first gas liquid separation chamber 54 communicates with the valve actuation chamber 44. In other words, the second communication hole 68 is formed in a part of the rear wall 54D of the first gas liquid separation chamber 54 opposing the bulging portion 67 via the gap G. The second communication hole 68 has a smaller cross sectional area than the first communication hole 65, and is disposed at the lower end of the rear wall 54D of the first gas liquid separation chamber 54. The second communication hole 68 is located at a position aligning with the intake cam holder 48 positioned between the second cylinder 8 and the third cylinder 8 with respect to the lateral direction, or, in other words, at a position offset from the cam 46*a* of the intake camshaft 46 and behind the intake cam holder 48.

As shown in FIG. 11, a pair of ribs 69 are formed in a rear end part of the head cover main body 41 adjacent to the fastening boss 41C disposed between the second cylinder 8 and the third cylinder 8 so as to extend over the inner surface of the peripheral wall 41B and the lower surface of the first gas liquid separation chamber 54. The ribs 69 connect the fastening boss 41C provided on the rear edge of the head cover main body 41 with the other fastening boss 41C provided on the front edge of the head cover main body 41, and are each provided with an arcuate lower edge. Each rib 69 extends vertically along the inner surface of the peripheral wall 41B at each end thereof. In particular, the ribs 69 are connected to the respective lateral ends of each fastening boss 41C at the front and rear edges thereof. Also, the ribs 69 delimit the side ends of the gap G at the side ends of the bulging portion 67 provided on the rear edge of the head cover main body 41.

The mode of operation of the breather device described above is discussed in the following.

As shown in FIGS. 5 and 7, the blow-by gas passage 39 (upstream breather passage 36A) is formed in the rear left part of the internal combustion engine 1. Therefore, when the vehicle accelerates while turning to the right, the oil surface tilts in the oil reservoir 33 so as to be higher on the rear left side with respect to the internal combustion engine 1. As a result, the lower end of the breather passage 36 may be submerged in the oil. At this time, the oil in the oil reservoir 33 is drawn up by the intake negative pressure and rises in the upstream breather passage 36A, but since the first communication hole 65 is formed in the lower wall 54A of the first gas liquid separation chamber 54, the air in the valve actuation chamber 44 flows into the first gas liquid separation chamber 54 via the first communication hole 65 so that the negative pressure in the first gas liquid separation chamber 54 is relieved and the rise of the oil is restrained.

Since the first communication hole 65 is formed in the vicinity of the gas inlet hole 57 (the upstream breather passage 36A) in the lower wall 54A of the first gas liquid separation chamber 54, the first communication hole 65 can be readily submerged in the oil. More specifically, the first communication hole 65 is positioned so as to be readily submerged in the oil as soon as the oil rising in the breather passage 36 reaches the first gas liquid separation chamber 54, and, furthermore, is positioned so low that the oil separated in the first gas liquid separation chamber 54 tends to be collected in the part surrounding the first communication hole 65.

In the illustrated embodiment, the second communication hole 68 communicating the first gas liquid separation chamber 54 with the valve actuation chamber 44 is formed in the part of the rear wall 54D of the first gas liquid separation chamber 54 located on the downstream side of the first communication hole 65. The second communication hole 68 is less prone to be submerged in the oil than the first communication hole 65, and therefore, when the upstream end of the upstream breather passage 36A is submerged in the oil, air can be supplied to the first gas liquid separation chamber 54 via the second communication hole 68 so that the negative pressure in the first gas liquid separation chamber 54 is weakened by the air drawn into the first gas liquid separation chamber 54 via the second communication hole 68. Also, the provision of the second communication hole 68 can reduce the cross sectional area of the first communication hole 65, so that the intrusion of oil from the valve actuation chamber 44 into the first gas liquid separation chamber 54 in normal times can be minimized.

As discussed above, since the cross sectional area of the second communication hole 68 is smaller than the cross sectional area of the first communication hole 65, the oil in the valve actuation chamber 44 is prevented from flowing into the first gas liquid separation chamber 54 via the second communication hole 68.

As shown in FIGS. 9 and 10, the space defined between the rear wall 54D of the first gas liquid separation chamber 54 and the opposing part of the peripheral wall 41B is relatively inaccessible for the oil that is dispersed in the first gas liquid separation chamber 54. In the illustrated embodiment, since the second communication hole 68 is formed in the part of the rear wall 54D facing this space, the oil in the valve actuation chamber 44 is effectively prevented from entering the first gas liquid separation chamber 54 via the second communication hole 68.

As shown in FIG. 11 also, the peripheral wall 41B of the head cover main body 41 is provided with the bulging portion 67 bulging outward so as to form the gap G between the rear wall 54D and the bulging portion 67. The oil in the valve actuation chamber 44 is prevented from readily infiltrating into this gap G. In the illustrated embodiment, since the second communication hole 68 is formed in the part of the rear wall 54D opposing the bulging portion 67 via the gap G, the oil in the valve actuation chamber 44 is prevented from entering the first gas liquid separation chamber 54 by flowing through the second communication hole 68. Further, the gap G can be created between the peripheral wall 41B and the rear wall 54D, and the second communication hole 68 can be formed in the rear wall 54D so as to oppose the gap G without increasing the overall size of the head cover main body 41.

As shown in FIGS. 4 and 11, the head cover main body 41 is provided with the fastening bosses 41C protruding outward from the peripheral wall 41B and fastened to the cylinder head 3, and the bulging portion 67 is provided in the part of the peripheral wall 41B formed with one of the fastening bosses 41C so that the head cover main body 41 for creating the gap G is not required to be unduly increased in size.

As shown in FIGS. 9 to 11, the head cover main body 41 is provided with the pair of ribs 69 extending along the inner surface of the peripheral wall 41B and the lower surface of the lower wall 54A, and reaching the common fastening boss 41C. The gap G defined between the ribs 69 is relatively inaccessible for the oil in the valve actuation chamber 44. In the illustrated embodiment, since the second communication hole 68 communicates with the gap G between the pair of ribs 69, the oil in the valve actuation chamber 44 is also prevented from infiltrating into the first gas liquid separation chamber 54 via the second communication hole 68. The ribs 69 also contribute to increasing the rigidity of the peripheral wall 41B of the head cover main body 41.

The oil splashed by the cams 46*a* and 47*a* during the rotation of the intake camshaft 46 and the exhaust camshaft 47 is thrown in the radial direction of the camshafts 46 and 47. In the illustrated embodiment, as shown in FIGS. 2, 8 and 9, the intake camshaft 46 and the exhaust camshaft 47 extend in the cylinder row direction in the valve actuation chamber 44, but because the second communication hole 68 (FIG. 9) is offset from the cams 46*a* and 47*a* of the intake camshaft 46 and the exhaust camshaft 47 with respect to the cylinder row direction, the oil is prevented from flowing into the liquid separation chamber 54 via the second communication hole 68.

As shown in FIGS. 9 to 11, since the second communication hole 68 is provided in the lower end part of the rear wall 54D, the oil separated from the blow-by gas in the first gas liquid separation chamber 54 is allowed to return to the valve actuation chamber 44 via the second communication hole 68. In other words, the second communication hole 68 functions not only as an air supply hole in case the upstream end of the upstream breather passage 36A inundated with oil but also as an oil return hole.

Since the second communication hole 68 is disposed so as to align with the oil return passage 38 with respect to the cylinder row direction, the oil separated from the blow-by gas in the first gas liquid separation chamber 54 can be quickly forwarded to the oil return passage 38 via the second communication hole 68 to be returned to the oil reservoir 33.

As shown in FIGS. 1 and 4, the first gas liquid separation chamber 54 and the second gas liquid separation chamber 55 are communicated with each other via the PCV valve 60, and the first communication hole 65 and the second communication hole 68 communicate the first gas liquid separation chamber 54 with the valve actuation chamber 44. Therefore, the air in the valve actuation chamber 44 can enter the first gas liquid separation chamber 54 via the second communication hole 68, but the oil that may be entrained by the air is trapped in the downstream side part of the first gas liquid separation chamber 54 and the second gas liquid separation chamber 55 so that the amount of oil flowing into the downstream breather passage 36B is minimized.

Although the present invention has been described in terms of a preferred embodiment thereof, it is obvious to a person skilled in the art that various alterations and modifications are possible without departing from the scope of the present invention.

The invention claimed is:

1. A breather device of an internal combustion engine having a plurality of cylinders arranged in a row, comprising;

a head cover main body having an upper wall extending over at least a large part of a cylinder head of the engine and including a downwardly recessed part, and a peripheral wall depending from a peripheral part of the upper wall, a lower end of the peripheral wall abutting the cylinder head to define a valve actuation chamber jointly with the cylinder head;

a chamber forming member attached to the upper wall of the head cover main body so as to define a breather chamber extending in a cylinder row direction in cooperation with the upper wall of the head cover main body;

an upstream breather passage communicating a first end of the breather chamber with a crank chamber;

a downstream breather passage communicating a second end of the breather chamber with an intake passage;

an oil return passage formed in the cylinder head to communicate the valve actuation chamber with the crank chamber;

a first communication hole formed in a lower part of the downwardly recessed part adjoining the first end of the breather chamber to communicate the breather chamber with the valve actuation chamber; and a second communication hole formed in a part of the breather chamber downstream of the first communication hole to communicate the breather chamber with the valve actuation chamber, wherein the second communication hole is formed in a lower part of a side wall defining the downwardly recessed part, a gap facing the valve actuation chamber being defined between the peripheral wall and the side wall, and wherein a part of the peripheral wall opposing the gap includes a bulging part that bulges locally outward from adjoining parts of the peripheral wall and defines the gap.

2. The breather device according to claim 1, wherein the second communication hole has a smaller cross sectional area than the first communication hole.

3. The breather device according to claim 1, wherein the bulging part is provided with a boss having a hole for receiving a fastener that fastens the head cover main body to the cylinder head.

4. The breather device according to claim 3, wherein the upper wall of the head cover main body is provided with a pair of ribs projecting from a lower surface thereof and extending substantially orthogonally to a lengthwise direction of the breather chamber to the boss on either side of the second communication hole.

5. The breather device according to claim 4, wherein the ribs extend along the side wall of the downwardly recessed part.

6. The breather device according to claim 1, wherein a camshaft extends in the cylinder row direction in the valve actuation chamber, and the second communication hole is offset from any of cams of the camshaft with respect to the cylinder row direction.

7. The breather device according to claim 1, wherein the second communication hole is positioned so as to substantially align with the oil return passage.

8. The breather device according to claim 1, wherein the first communication hole is formed with a guide plate extending horizontally at a lower end of the first communication hole.

9. The breather device according to claim 1, wherein the breather chamber is provided with a bottom surface which is slanted downward toward the first end of the breather chamber, and toward one side of the breather chamber, the upstream breather passage opening out on the one side of the breather chamber on the first end of the breather chamber while the first communication hole opens out on another side of the breather chamber on the first end of the breather chamber.

10. The breather device according to claim 1, wherein the breather chamber includes a first gas liquid separation chamber extending from the first end in the cylinder row direction, and a second gas liquid separation chamber having one end connected to an end of the first gas liquid separation chamber remote from the first end via a PCV valve and extending from the one end thereof to the second end of the breather chamber in parallel with the first gas liquid separation chamber, the first communication hole and the second communication hole communicating the first gas liquid separation chamber with the valve actuation chamber.

* * * * *